United States Patent [19]

McCalmont

[11] 4,162,008

[45] Jul. 24, 1979

[54] SHIPPING AND DISPLAY CARTON FOR AN ELECTRIC LAMP OR SIMILAR ARTICLE, AND RESULTING PACKAGE

[75] Inventor: David McCalmont, Bloomfield, N.J.

[73] Assignee: Westinghouse Electric Corp., Pittsburgh, Pa.

[21] Appl. No.: 900,944

[22] Filed: Apr. 28, 1978

[51] Int. Cl.[2] ..... B65D 5/50

[52] U.S. Cl. ..... 206/590; 206/45.14

[58] Field of Search ..... 206/45.14, 45.19, 418, 206/588, 590; 229/39 B

[56] References Cited

U.S. PATENT DOCUMENTS

| | | | |
|---|---|---|---|
| 1,581,921 | 4/1926 | Doble | 206/485 |
| 1,619,608 | 3/1927 | Fairchild | 229/39 B |
| 2,537,151 | 1/1951 | Mires | 229/39 B |
| 4,054,203 | 10/1977 | Farquhar | 206/45.14 |

FOREIGN PATENT DOCUMENTS

| | | | |
|---|---|---|---|
| 181236 | 7/1954 | Austria | 229/39 B |
| 197455 | 8/1938 | Switzerland | 229/39 B |
| 209618 | 1/1924 | United Kingdom | 229/39 B |
| 941596 | 11/1963 | United Kingdom | 229/39 B |

*Primary Examiner*—Herbert F. Ross
*Attorney, Agent, or Firm*—D. S. Buleza

[57] ABSTRACT

A reflector-type incandescent lamp having a glass envelope with an end face or lens component that is coated with a film of colored plastic is retained within a paperboard shipping and display carton by a peripheral flange structure and an end closure that are formed by integral parts of the carton. The plastic-coated end face of the lamp envelope is protected from abrasion damage by the rough edges of the tabular members which form the retaining-flange structure by a shield-panel that also constitutes an integral part of the carton and is automatically pulled into overlapping relationship with the flange structure when the carton is erected into tubular form from collapsed condition. The shield-panel is so shaped that it provides a non-abrasive continuous pad for the coated end face of the packaged lamp.

8 Claims, 10 Drawing Figures

SHIPPING AND DISPLAY CARTON FOR AN ELECTRIC LAMP OR SIMILAR ARTICLE, AND RESULTING PACKAGE

BACKGROUND OF THE INVENTION

1. Field of the Invention

This invention relates to the packaging art and has particular reference to an improved carton for shipping and displaying a fragile article such as an electric lamp which has an abrasion-sensitive envelope, and to an improved package which utilizes such a carton.

2. Description of the Prior Art

When marketing fragile articles such as electric lamps it is customary to protect the articles from damage during shipment by placing the articles in a container or carton composed of suitable packaging material. In the case of certain types of incandescent lamps, such as those designed for decorative lighting and the like, the carton is so constructed that it has viewing apertures which attractively display the packaged lamp when it is placed in stores and other merchandising outlets. Various prior art shipping and display cartons for articles such as electric lamps which employ combinations of foldable tabs, flaps, panels, platforms, etc. for retaining and exposing the packaged items are described in the following U.S. Pat. Nos.:

3,181,694 issued May 4, 1965 to E. B. Candell
3,337,033 issued Aug. 22, 1973 to R. A. Cote
3,734,397 issued May 22, 1973 to R. A. Cote
3,770,116 issued Nov. 6, 1973 to R. A. Cote
3,941,304 issued Mar. 2, 1976 to T. Barbieri et al.

In certain types of electric incandescent lamps, for example floodlamps designed for decorative lighting applications, the end face or lens portion of the glass envelope is coated with a colored plastic film to enhance the decorative effect of the light rays. Such coatings are also used on lamps for other functional purposes such as emergency signalling, etc. Since the colored films are very susceptible to scuffing or damage by abrasion, they present a rather unique problem from the packaging standpoint since the carton must protectively enclose the lamp without rubbing against the plastic coating and ruining it while the lamp is being shipped.

In accordance with one solution to this abrasion problem, a separate liner or pad of cardboard was placed into the end of the carton before the lamp was inserted to cover the rough protruding edges of the lamp-retaining portions of the carton and prevent them from contacting and rubbing against the plastic-coated end portion of the lamp envelope. While this arrangement was satisfactory from a lamp protection standpoint, it was expensive and constituted a production bottleneck since it required the manufacture of an additional packaging component and an additional operation in the lamp factory to insert such a component into the carton before the lamp could be loaded.

SUMMARY OF THE INVENTION

The aforementioned cost and production drawbacks are eliminated in accordance with the present invention by cutting and scoring the packaging material from which the carton is fabricated in such a manner that the abrasion-shield component comprises a panel that constitutes an integral part of the carton and is automatically pulled into the proper protective position when the carton is set up into tubular form for loading from its collapsed condition. The shield-panel is preferably combined with selected portions of foldable tabular members that are also automatically actuated when the carton is erected and form a peripherally-extending flange structure which reinforces the shield-panel and holds the lamp within the carton while exposing a portion of its engaged end face to view for display purposes.

BRIEF DESCRIPTION OF THE DRAWINGS

A better understanding of the invention will be obtained from the exemplary embodiment shown in the accompanying drawings, wherein.

DESCRIPTION OF THE PREFERRED EMBODIMENT

While the present invention can be used to package various articles of merchandise which have surface portions that can be easily damaged by abrasion of the carton in which it is packaged, it is especially adapted for use in conjunction with electric lamps of the type that have envelopes with plastic-coated end portions and it has accordingly been so illustrated and will be so described.

A lamp package P embodying the invention is shown in FIGS. 1—4. As illustrated, the package consists of a carton C that is made from stiff packaging material such as and encloses a reflector-type incandescent lamp L. The carton is of tubular configuration and has a window opening at one end which attractively displays a selected portion of the lamp.

Figure 1:
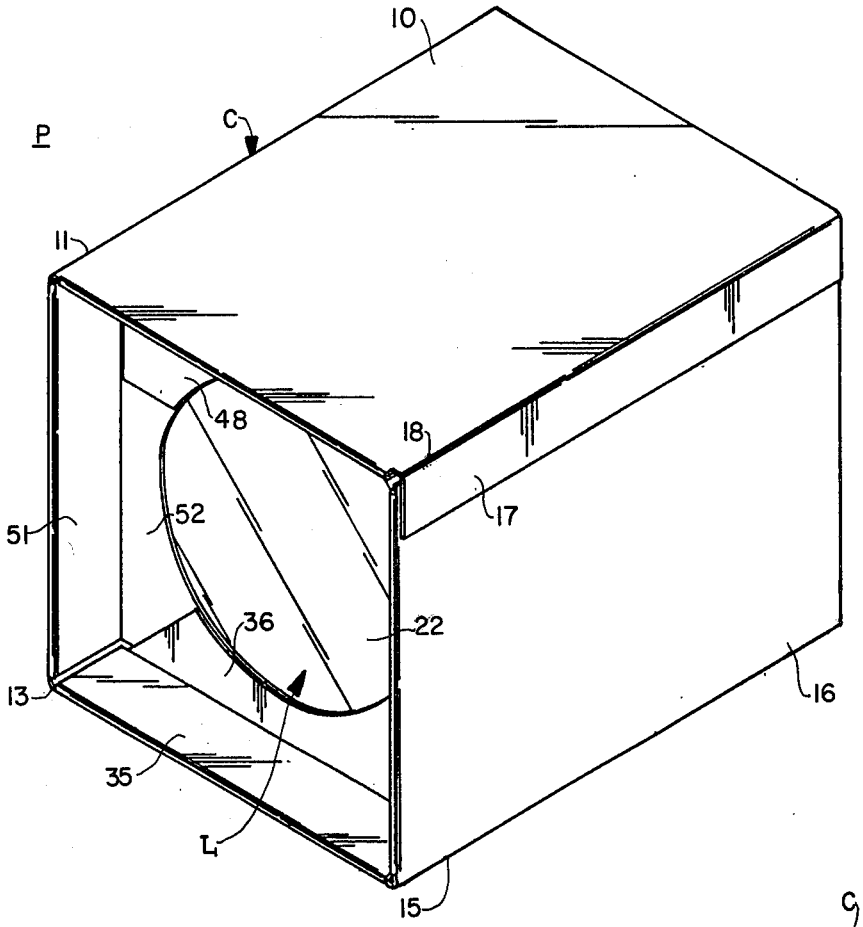
FIG. 1 is a perspective view of an electric lamp package embodying the invention.
Figure 3:
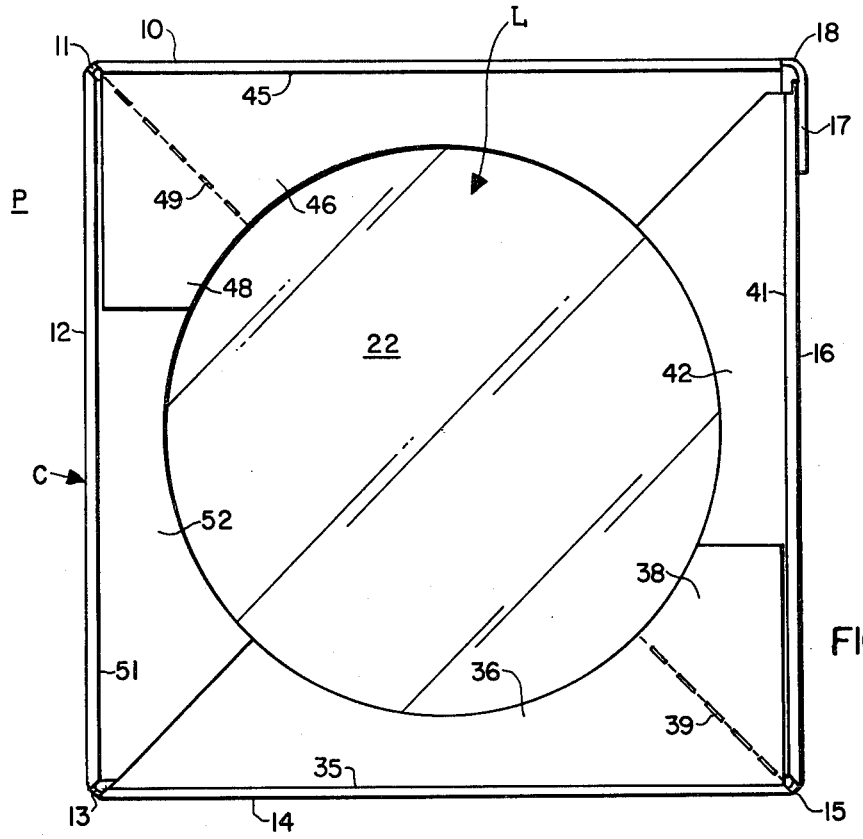
FIGS. 3 and 4 are front and rear elevational views, respectively, of the lamp package shown in FIGS. 1 and 2.
Figure 4:
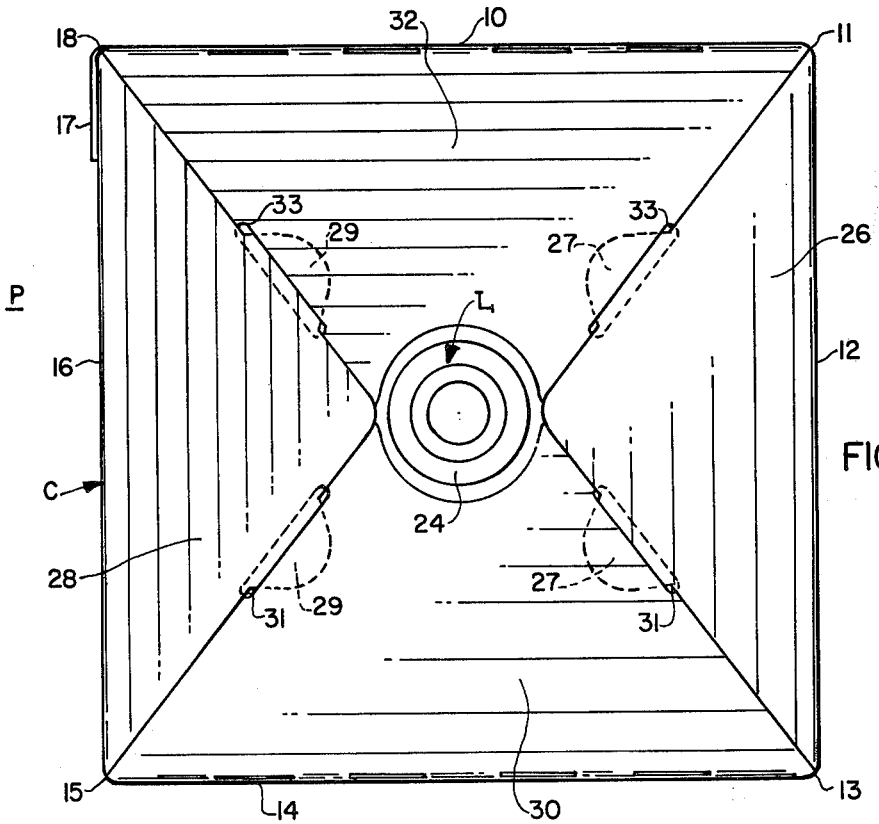

As will be noted in FIGS. 1, 3 and 4, the carton C is of square cross-section and has four walls 10, 12, 14 and 16 that are hingedly interconnected along score lines 11, 13 and 15. The walls are held in assembled form by a glue panel 17 that is hingedly connected to wall 10 along a score line 18. The carton C is thus collapsible for bulk shipment from the box-maker to the lamp factory and can then be set up and erected for loading by simply applying pressure to opposite side edges of the collapsed carton.

Figure 2:
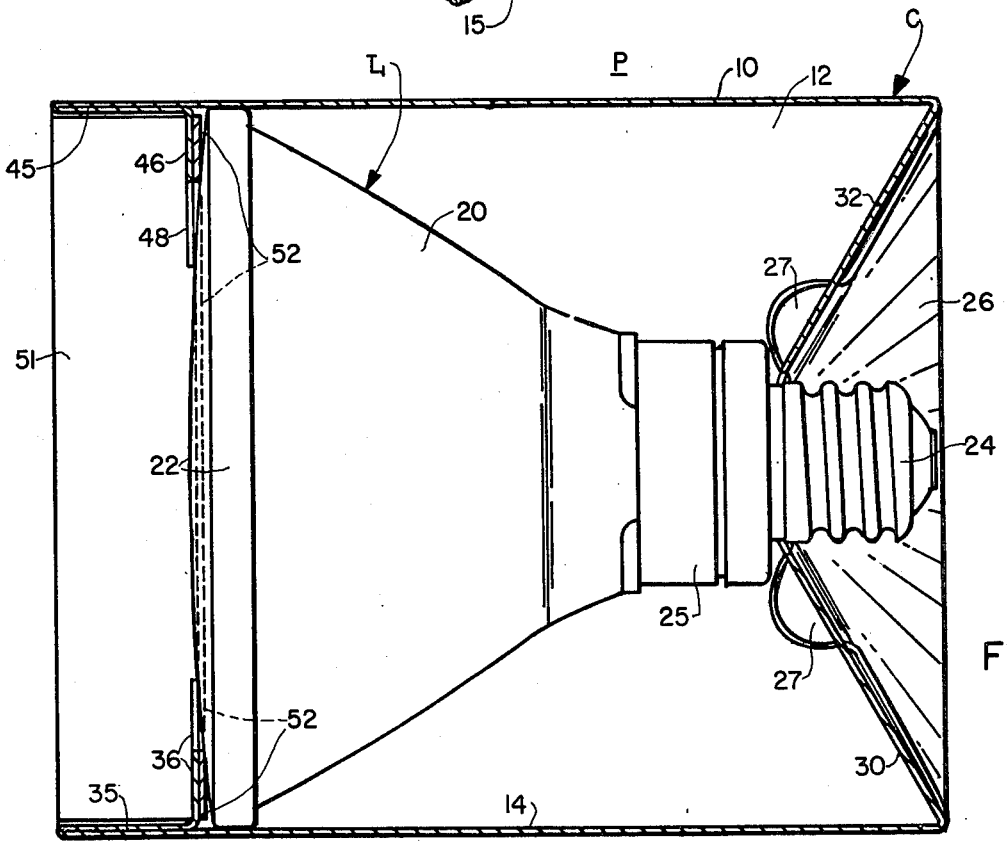
FIG. 2 is a sectional view through the lamp package showing the internal structure of the carton.

As shown more particularly in FIG. 2, the incandescent lamp L consists of a reflectorized glass envelope 20 having an enlarged end portion that is hermetically sealed to a glass lens 22 that is coated with a thin film of colored plastic (such as a tinted silicone resin) which can be easily damaged by scuffing or abrasion produced by the tight-fitting carton as it rubs against the convex end face of the envelope when the packed lamp L is being shipped. The opposite end of the lamp envelope 20 is fitted with a suitable base member 24 that is secured to the envelope by a metal skirt 25.

The lamp L is snugly retained within the confines of the carton C by two pairs of end flaps 26, 28 and 30, 32 (see FIGS. 2 and 4) that are hingedly connected to the respective walls and are folded inwardly toward and form an end closure which interlockingly engages the base member 24 of the lamp L. The ends of flaps 30, 32 are provided with semi-circular cutouts to effect an interlocking fit with the base member and the flaps are releasably locked with one another by a pair of tongues 27 on flap 26 and another set of tongues 29 on flap 28 which slip into and engage slot openings 31 in flap 30 and another set of slot openings 33 in flap 32, as shown in FIG. 4.

The opposite end of the incandescent lamp L is anchored in place by an inwardly-protruding flange structure that extends around the inner periphery of the carton C and is formed by a series of tabular extensions of the respective walls that are inturned into the carton C. Each tabular extension has a portion that is secured (as by gluing) to the inner surface of the respective walls, and an unattached end segment that protrudes inwardly into the carton interior and forms part of the flange structure. As shown in FIGS. 1 and 2 and particularly FIGS. 3 and 5, the tabular extension of wall 14 consists of segment 35 that is fastened to the wall and an upstanding unattached end segment 36 that protrudes inwardly into the carton and has a laterally-extending tab 38 that is hingedly coupled to end segment 36 by a diagonally extending slit-score line 39. Tab 38 is fastened (as by gluing) to the unattached end segment 42 of the tabular extension of wall 16, which extension is secured to the wall by an overlapped glued segment 41. The flange-forming end segments 36 and 42 are thus coupled to one another by a gusset assembly which is formed by the glued tab 38 and slit-score line 39, thus permitting the segments and gusset to lie flat within the collapsed carton C and then be automatically pulled into upstanding flange-forming position when the carton is erected.

Wall 10 of the carton C is also provided with a tabular extension consisting of a segment 45 that is glued to the inner surface of the wall and an unattached end segment 46 that has a tab 48 which is foldable along another diagonal slit-score line 49. Tab 48 is glued to the unattached end segment 52 of the tabular extension of wall 12 and this segment is anchored in place by a segment 51 which is glued to the inner surface of wall 12. Unattached end segment 52 is thus coupled to unattached end segment 46 by a second gusset assembly which is formed by tab 48 and slit-score line 49, so that these segments are also adapted to lie flat within the collapsed carton and be pulled into upstanding position when the carton C is erected. Diagonally-opposite corners of the carton are thus provided with foldable gusset assemblies or webs.

As will be noted in FIGS. 1–3 and 5, the unattached end segments 36, 42, 46 and 52 which form the retaining flange structure all have arcuate profiles and together define a circular window through which the convex end surface of the lens component 22 of the packed lamp L can be viewed.

Figure 5:
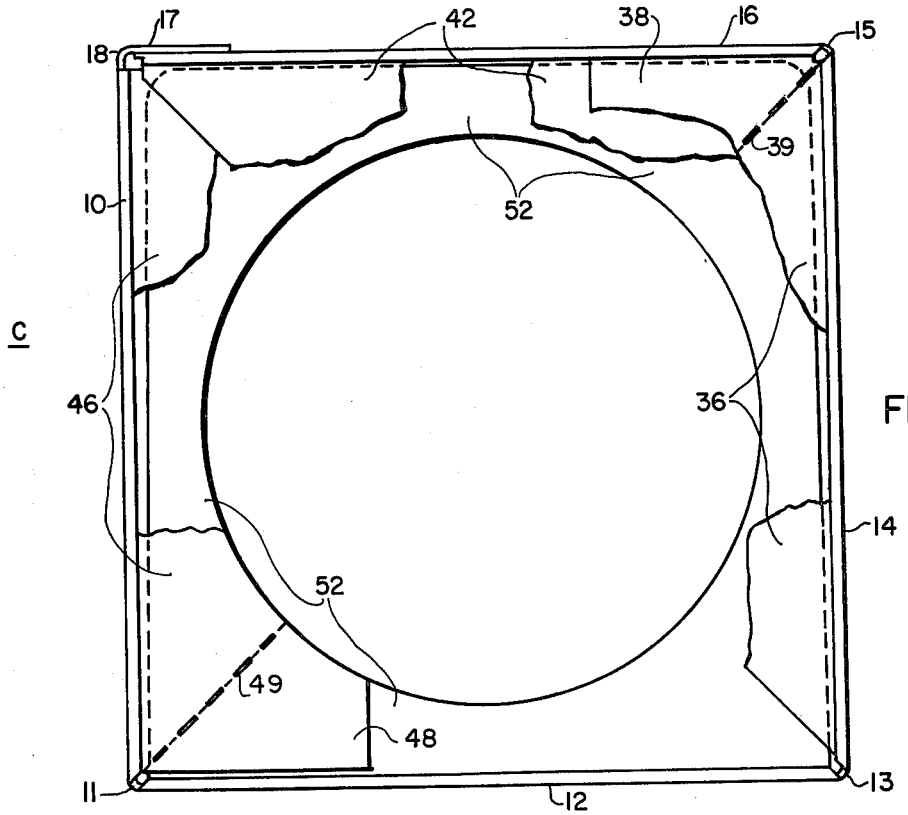
FIG. 5 is a front elevational view of the erected carton alone with the shield-panel component in place, portions of the overlying flange structure being removed for illustrative purposes.

In accordance with the present invention, the thin plastic coating on the lens face 22 of the lamp L is protected from scuffing by abrasion by the rough inwardly-protruding edges of the flange-forming segments by making the unattached segment 52 (which is integral with wall 12) of such size and shape that it comprises an apertured panel of square configuration shape that conforms to the cross-sectional configuration of the erected carton C and is sandwiched between the convex end surface of the lamp lens 22 and the retaining flange structure formed by the other unattached end segments 36, 42 and 46. This feature is shown in FIGS. 2 and 5. The panel 52 has a circular opening therein which matches the curvature of the individual end segments and, since the panel is continuous and has a smooth surface, it serves as a shield or pad which protects the plastic-coated lens 22 from damage by scuffing or abrasion during shipment and handling of the lamp package P. The shield-panel 52 is located behind and in aligned overlapped position relative to the end segments 36, 42 and 46 which form the retaining flange, as shown in FIG. 2 and more particularly in FIG. 5.

Figure 6A:
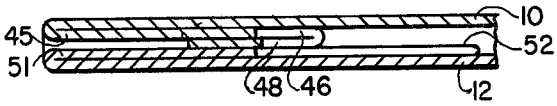
FIGS. 6A to 6C are side elevational views, partly in section, of a corner portion of the carton illustrating the manner in which the abrasion-shield panel is pulled into position by the coaction of the associated gusset assembly and walls when the collapsed carton is erected into tubular form.
Figure 6B:
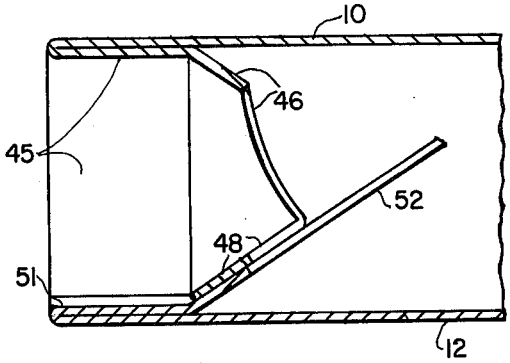
Figure 6C:
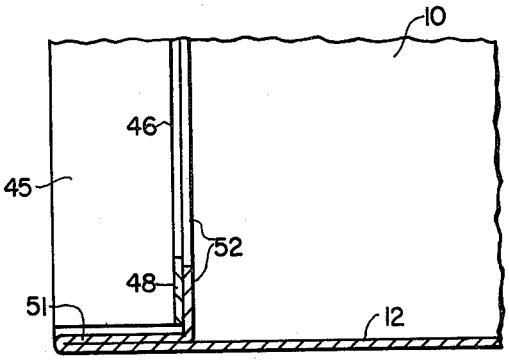

The improved carton C provides a labor-saving advantage in that the shield-panel 52 is automatically pulled into the proper position within the carton C when the latter is set up and erected for loading. This feature is shown in FIGS. 6A–6C which are fragmentary sectional views of the upper left-and corner portion of the carton C (as viewed in FIG. 3) and depict the manner in which the shield-panel 52 is pulled into position behind the flange-forming segments 36, 42 and 46 as the carton is erected from collapsed condition. As shown in FIG. 6A, when the carton is collapsed the apertured shield-panel 52 (along with its glued segment 51) lies flat between walls 10 and 12 together with the gusset assembly formed by tab 48 and the adjoined unattached segment 46 of the tabular extension that is secured to the wall 10 by the glued segment 45. As the carton is expanded or erected into tubular form and walls 10 and 12 separate (as shown in FIG. 6B), the gusset formed by coupled segment 46 and tab 48 pull the shield-panel 52 upwardly and swing it toward the adjacent open end of the carton. When the carton is fully erected (FIG. 6C), shield-panel 52 is seated behind the upstanding tab 48 and the upstanding flange structure that is formed by the movable end segment 46.

Figure 7A:
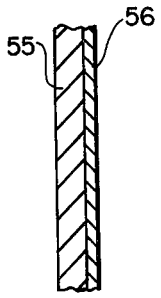
FIG. 7A is a fragmentary cross-sectional view of the packaging material from which the carton blank is formed.
Figure 7:
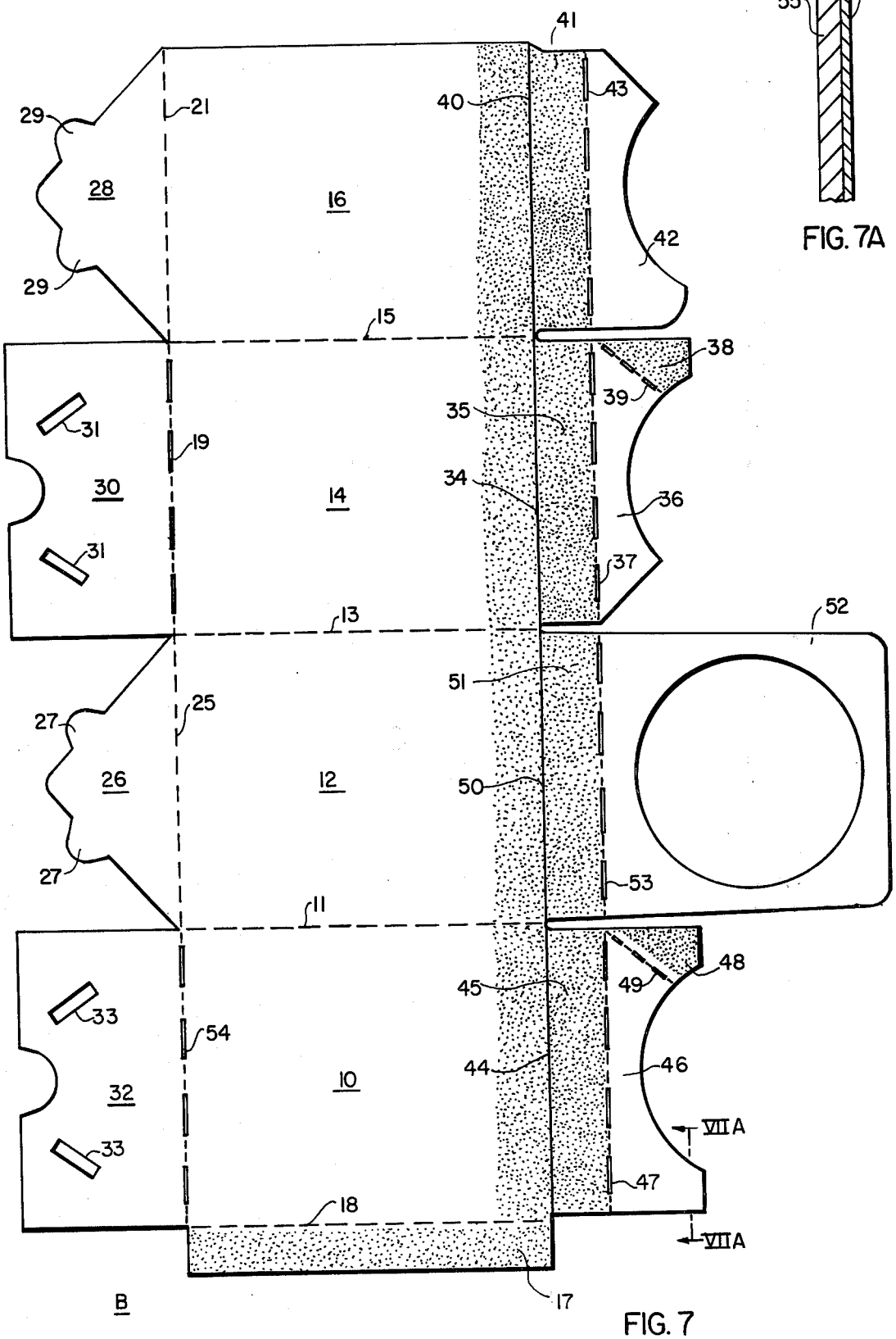
FIG. 7 is a plan view, on a reduced scale, of the blank from which the carton is formed.

The elongated blank B of paperboard from which the carton C is formed is shown in FIG. 7. As will be noted, the blank is divided into a series of rectangular wall panels 10, 12, 14 and 16 by score lines 11, 13 and 15 and wall 10 is provided with glue panel 17 that is hingedly joined to the wall by score line 18. In this Figure, the stippled portions of the blank B indicate the parts of the paperboard that are coated with a suitable adhesive and hold the blank in assembled carton form. The end-closure flaps 26, 28, 30 and 32 are hingedly secured to the respective walls along one side of the blank B, as illustrated. The flap 26 with its arcuate tongues 27 is hingedly connected to wall 12 by score line 25, end flap 28 with its pair of arcuate tongues 29 is hingedly connected to wall 16 by score line 21, end flap 30 with its arcuate cutout and locking slots 31 is hingedly fastened to wall 14 by slit-score line 19, and the remaining flap 32 having the other set of locking slots 33 is hingedly connected to wall panel 10 by slit-score line 54.

The flange-forming extensions and shield-panel member are secured to the other ends of the wall panels in the following manner. The tabular extension consisting of segments 35, 36 and tab 38 is hingedly attached to wall panel 14 by a slit line 34 (in order to permit segment 35 to be easily folded over and glued in tight overlapped relation with the wall). As shown in FIG. 7A, the paperboard from which the carton C and blank B are fabricated is of two-ply construction and consists of a relatively thick sheet of paperboard 55 that is covered by a thinner facing sheet 56 of paper which gives an attractive and pleasing appearance when printed with merchandising information and artwork. The slit line 34 extends through a major portion of the thick ply 55 of paperboard and permits a sharp bend to be made when the extensions are folded into overlapped relationship with the respective walls.

Returning to FIG. 7, flange-forming end segment 36 is hingedly connected to glue segment 35 by a slit-score line 37 (to permit free movement of segment 36), and tab 38 is hinged to segment 36 by another slit-score line 39 for the same reason. Wall panel 16 is hinged to anchoring segment 41 by slit line 40 and the flange-forming end segment 42 is hinged to segment 41 by slit-score line 43.

At the opposite end of the blank B, anchoring segment 45 is hinged to wall panel 10 by slit line 44, flange-forming end segment 46 is hinged to anchoring segment 45 by slit-score line 47, and anchoring tab 48 is hinged to segment 46 by another slit-score line 49. The apertured shield-panel member 52 is hinged to its anchoring segment 51 by slit-score line 53, and anchoring segment 51 is hinged to wall panel 12 by slit line 50.

I claim as my invention:

1. In a paperboard shipping and display carton for a fragile article of a type which has an end portion that is susceptible to damage by abrasion at regions where it contacts the carton, the combination comprising;

a plurality of connected walls which define a collapsible tubular sleeve, a tabular member depending from each of the respective walls and held in inturned relationship with the carton by a segment which is secured to the inner surface of the associated wall, said tabular members being disposed at the same end of the carton and each having an unattached end segment, and means coupling the unattached end segments of adjacent tabular members in paired foldable relationship in a manner such that the end segments are automatically pulled into upstanding position by the respective walls when the collapsed carton is erected into tubular form and said end segments then constitute inwardly-projecting flanges which extend along the periphery of the carton and are adapted to engage the end portion of an article that is inserted into the carton and thus retain the article in place while exposing a part of it to view, the unattached end segment of one of said tabular members being larger than the others and being so shaped and articulated that it constitutes an article-protective panel that lies flat within the carton, when the carton is in collapsed condition, and is pulled into upstanding position along with the unattached end segments of the other tabular members, when the carton is erected, and is thereby automatically positioned behind and in overlying relationship with each of the upstanding end segments of the other tabular members and thus constitutes a smooth continuous pad for the end face of an inserted article which shields the end face from the abrasive action of the laterally protruding end edges of said end segments of the tabular members.

2. The shipping and display carton of claim 1 wherein the article-protective panel is also fabricated from paperboard and extends completely around the inner periphery of the erected carton.

3. The shipping and display carton of claim 2 wherein said article-protective panel, tabular members and walls comprise parts of a single piece of paperboard.

4. The shipping and display carton of claim 2 wherein;

said carton has four walls, three of which have depending tabular members of approximately the same size, said article-protective panel is secured to the remaining wall of the carton, portions of two of said tabular members which are disposed at diagonally-opposite corners of the carton each have a laterally-extending tab, one of which is fastened to an adjacent unattached part of the article-protective panel and the other being fastened to an adjacent unattached part of the remaining tabular member and defining therewith a pair of foldable gusset assemblies that are located at the said diagonally-opposite corners of the carton and constitute said coupling means, and said tabular members and article-protective panel are pulled into their upstanding overlapping positions by the walls and the associated gusset assemblies when the collapsed carton is erected into its tubular form.

5. The shipping and display carton of claim 4 wherein;

said tabular members comprise inturned extensions of the respective walls to which they are attached, said article-protective panel comprises an apertured extension of the wall to which it is attached, and said tabular members and article-protective panel, when in their upstanding positions, provide an article-retaining flange structure that extends around the entire periphery of the erected carton.

6. The shipping and display carton of claim 5 wherein the end of said carton remote from said tabular members and article-protective panel include hinged flap means for closing that end of the carton after said carton has been erected into tubular form.

7. A package comprising;

a fragile article that has an end portion which is susceptible to surface damage by abrasion, and a carton protectively enclosing and displaying said article comprising a tubular sleeve of paperboard that has four interconnected walls, is collapsible, and snugly embraces said article, said carton having integral means for locking the article within the sleeve and shielding the end portion of the article from abrasion damage by the carton comprising (a) flap means hingedly attached to the carton walls and inturned into interlocked relationship with one another in a manner such that they form an end closure for the carton, (b) foldable tabular members hingedly secured to the walls at the other end of the carton and disposed in upstanding position within the carton along the periphery thereof and forming flange means that is located adjacent the abrasion-sensitive end portion of the article and is adapted to hold the article within the carton while exposing a part of the article to view, and (c) an apertured panel sandwiched between the flange-forming tabular members and the end face of the packaged article and defining a continuous smooth seating surface therefor which shields the end portion of the article from abrading action by the inwardly-protruding edges of the tabular members, said shield-panel being secured to one of the tabular members at a corner portion of the carton by a foldable gusset which automatically positions the shield-panel behind and in aligned relationship with the peripheral flange formed by the upstanding tabular members when the carton is expanded into tubular form from collapsed condition.

8. The package of claim 7 wherein;

said article comprises an electric lamp having a glass envelope with an end portion that is coated with a thin film of tinted plastic, and said sleeve, tabular members and shield-panel member constitute parts of a single piece of paperboard.

* * * * *